United States Patent [19]

Aulenbacher

[11] 4,068,711

[45] Jan. 17, 1978

[54] CASING CUTTER

[75] Inventor: Merle W. Aulenbacher, Conroe, Tex.

[73] Assignee: International Enterprises, Inc., Houston, Tex.

[21] Appl. No.: 680,470

[22] Filed: Apr. 26, 1976

[51] Int. Cl.[2] ..... E21B 29/00

[52] U.S. Cl. ..... 166/55.3; 175/288

[58] Field of Search ..... 166/55.2, 55.3, 55.6, 166/55.7, 55.8, 55.3; 175/202, 263, 267, 281, 284, 285, 288

[56] References Cited

U.S. PATENT DOCUMENTS

| | | | |
|---|---|---|---|
| 973,994 | 10/1910 | Swan | 166/55.3 |
| 981,306 | 1/1911 | Pollack | 175/286 |
| 1,485,642 | 3/1924 | Stone | 175/288 X |
| 1,777,713 | 10/1930 | Braden | 166/55.8 |
| 1,814,048 | 7/1931 | Lincoln | 166/55.7 |
| 1,913,686 | 6/1933 | King | 166/55.8 |
| 2,322,695 | 6/1943 | Kinzbach | 166/55.8 |
| 2,705,998 | 4/1955 | Spang | 166/55.3 |

FOREIGN PATENT DOCUMENTS

| | | | |
|---|---|---|---|
| 1,121,402 | 8/1956 | France | 175/286 |

*Primary Examiner*—Ernest R. Purser
*Assistant Examiner*—Richard E. Favreau
*Attorney, Agent, or Firm*—Browning, Bushman & Zamecki

[57] ABSTRACT

A casing cutter adapted to be lowered into a well to cut a plurality of casings cemented in the well and having a body with a central passageway therethrough with a piston slidably mounted therein which piston is provided with a restriction so that the piston moves axially within the body, a plurality of blades which are connected to the piston, and mounted in openings in the body, and guide means between the blades and the body whereby when the piston is actuated the blades are moved outwardly in a generally arcuate path so that they cut a very narrow annular space, which is substantially only that space which the blade displaces in its outer position.

16 Claims, 8 Drawing Figures

CASING CUTTER

BACKGROUND OF THE INVENTION

In the drilling of oil wells it is often desirable and sometimes required to sever and recover the well casing. In marine drilling the submarine well head equipment is very expensive and when the well is abandoned it can be recovered by severing the casings in the well bore and retrieving the severed casings and well head equipment. Also in some locations, the submarine well head equipment and a portion of its casing must be recovered to assume that they do not become a hazard to navigation.

Prior to my present invention, there have been many casing cutters which are adapted to be lowered into a well bore and to sever the casing cemented therein. The Sanford, U.S. Pat. No. 3,331,439 discloses one form of such cutter. This general type of casing cutter is illustrated in the drawings of the present application as a sample of the prior art. Such patent discloses a cutter having arms that pivot outwardly from a point mounted on the body of the cutter and are of sufficient length so that they can move outward to cut the outermost casing which they will encounter. In doing so, such blades cut a very substantial portion of the innermost casing and much of the cement between the casings before finally severing the outermost casing.

Another structure of the prior art is disclosed in the Kinzbach, U.S. Pat. Nos. 2,322,695 and 2,322,694. Such devices have arcuate cutting blades adapted to move outward but such cutters are not capable of cutting a large diameter swath as through a plurality of surrounding (concentric or eccentric) casings. The present invention relates to an improved casing cutter for use in a well bore which is capable of severing a plurality of casings with a minimum removal of casing material and the cement between the casings. Such cutter, by use of improved guide means, translates part of the longitudinal force produced responsive to the circulation of fluids downwardly through the drill string into a radially outward extension of a plurality of arcuate blades. Upon rotation of the tool, such blades cut a very narrow swath through the casing and cement between the casings so that they remove substantially only the amount of material to allow the swath to have the shape of the blade.

The movement of each blade relative to the body of the tool is in a path which is generally arcuate in a longitudinal plane. Guide means cooperative between the tool body and the blade are provided to guide the blade in this arcuate path. The guide means are disposed so that they will not unduly limit the downward movement of the actuating mechanism so that the the blades may be extended outwardly of the body over the major portion of their lengths. This allows a relatively large diameter swath to be cut without using excessively long blades.

An object of the present invention is to provide an improved casing cutter for use in a well which is adapted to sever multiple surrounding casings with a minimum amount of cutting and removal of material.

Another object is to provide an improved well casing cutter which will sever multiple casings within the well bore with a minimum amount of wear on the cutter blades.

BRIEF DESCRIPTION OF THE DRAWINGS

These and other objects and advantages of the present invention are hereinafter set forth and explained with respect to the drawings wherein:

FIG. 3 is a partial sectional view of the casing cutter of the present invention showing the cutter blades in their retracted position during running in.

DESCRIPTION OF THE PREFERRED EMBODIMENTS

Figure 1:
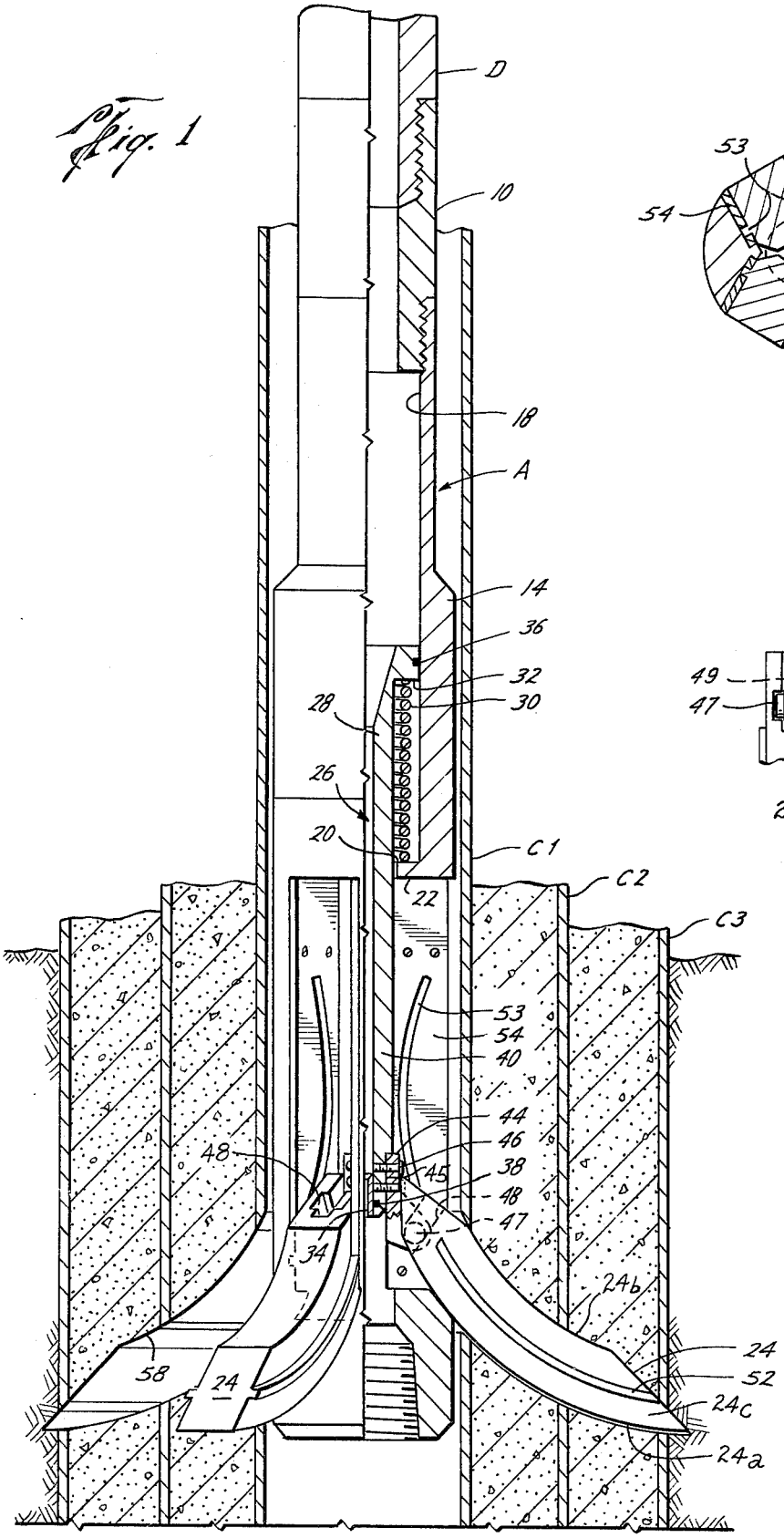
FIG. 1 is a view of the casing cutter of the present invention shown in the extended position wherein the cut of the outermost casing is complete. The tool is shown in quarter section and the casings are shown in sectional view to clearly illustrate the narrow swath cut by the blades.
Figure 2:
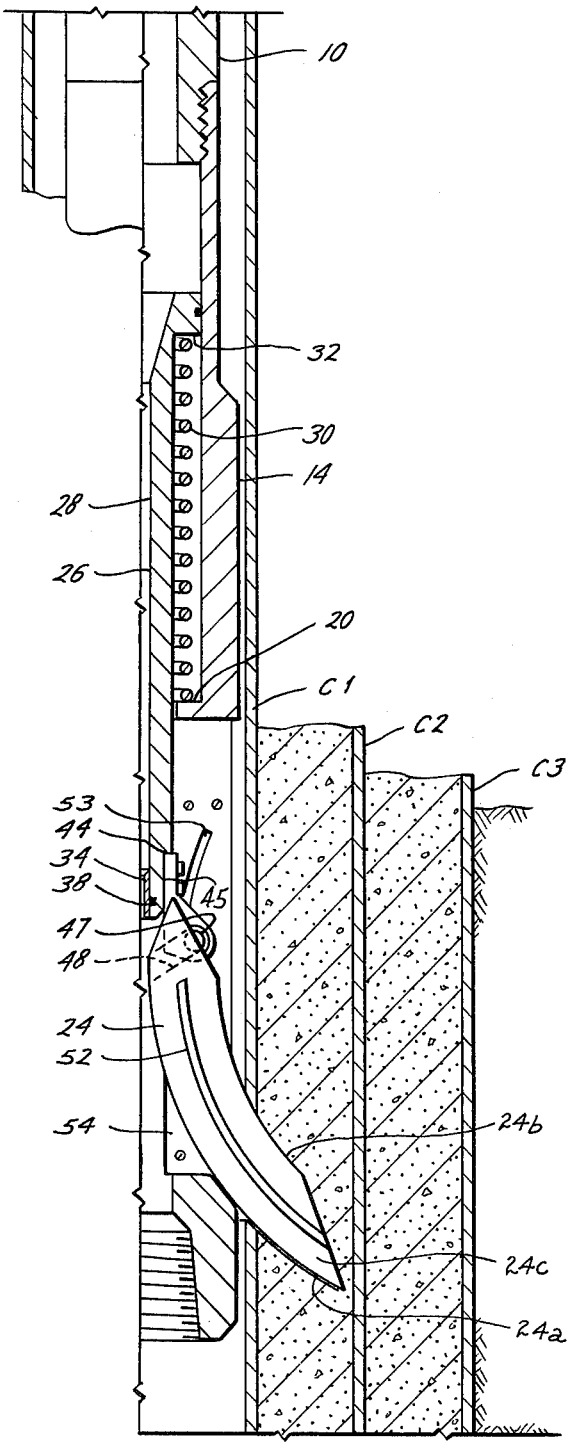
FIG. 2 is a partial sectional view of the casing cutter of the present invention showing the cutter blades in partially extended position.

As shown in FIGS. 1 and 2, the preferred form of casing cutter includes the body A which is adapted to be connected to the tool string D as hereinafter described. The well tool is adapted to be lowered into a well bore within the series of casings, $C_1$, $C_2$ and $C_3$, which are to be severed.

Figure 4:
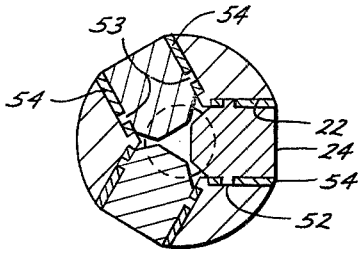
FIG. 4 is a sectional view taken along line 4—4 of FIG. 3 and showing the tool having three cutter blades.

The casing cutter body A includes the upper housing 10 having internal threads which are adapted to receive the drill string D and the main body or housing 14. The housing 14 defines a central passageway through which fluid may be circulated downwardly from the drill string D in the usual manner. The interior of housing 14 is recessed to provide the cylinder 18. Cylinder 18 terminates in the shoulder 20 at its lower end. The lower part of housing 14 defines a plurality of lateral openings 22 into which the blades 24 are positoned. This can be best seen in FIGS. 1 and 4. The openings 22 extend radially through housing 14 to allow the blades to move outwardly as hereinafter described.

Actuating means 26 is provided within the housing 14 and includes the piston 28 which is adapted to slide within the cylinder 18. The spring 30 is positioned within the cylinder 18 in abutting relation between shoulder 20 and shoulder 32 defined on piston 28. This spring 30 exerts a force on piston 28 in the upward direction tending to return the piston 28 to its upper or retracted position as hereinafter explained.

In order to actuate the piston 28, orifice 34 is suitably secured within the interior of the piston 28 to create a restriction to the flow of fluid through the interior of the piston 28. With a sufficient flow of fluid this restriction creates a pressure above the piston greater than the pressure downstream of the orifice 34 to cause the piston to move downwardly within the cylinder 18. A suitable seal, such as O-ring 36, is provided on the exterior of the piston 28 and is adapted to seal against cylinder 18. Also suitable O-ring 38 is provided to seal between the orifice 34 and the piston 28. The lower portion of the piston 28 forms the tubular sleeve 40.

Figure 5:
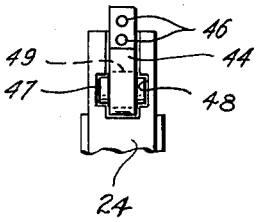
FIG. 5 is a view of the means connecting from the piston to the blade taken along line 5—5 in FIG. 3.

Each blade 24 comprises a convex surface 24*a* facing radially inwardly when the blade is in its retracted position (FIG. 3), a parallel concave surface 24*b* facing radially outwardly when the blade is in its retracted position, and parallel planar side surfaces 24*c* which lie in generally radial planes. With the movement within the housing 14 being provided by the actuating means 26, a suitable connecting means is provided to transmit the longitudinal force developed by the piston 28 responsive to the pressure differential thereacross to the cutting blades 24. The connecting means includes the inserts 44 which are secured in an annular external groove 45 around the lower end of piston 28 by the screws 46. The inserts 44 each have a pin 47 projecting outwardly from both sides as shown in FIG. 5. Such pins 47 are adapted to be positioned in the slot 48 defined in the blade 24. The pin 47 is preferably mounted within insert 44 by the bushings 49 which allow the pin to rotate when it is in tight engagement with one side of the slot 48 (to be described more fully below) to reduce friction as the pin and slot move relative to each other.

Each of the pins 47 and its corresponding insert 44 is slidably received in a slot 48 in a respective one of the blades 24. As viewed looking toward the top end surface of the blade, each slot 48 is generally T-shaped (see FIG. 5 and left side of FIG. 1). Each slot 48 is also extended in a generally radial direction, as shown in dotted lines in FIGS. 1–3, for a purpose to be described more fully below. Pins 47 impart the longitudinal forces of the piston 28 to the blades 24 during extension and retraction thereof.

For proper operation of the blade, a suitable guiding means is provided to guide the movement of the blade in a path which is generally arcuate in a longitudinal plane and to translate a part of the longitudinal downward piston force into a radial outward extension and cutting force on the blades 24 against the well casings. Such guiding means includes the arcuate keys 52 which are secured to or integral with each side 24*c* of the blades 24 and the mating arcuate slots 53 which are formed in wear plates 54. Plates 54 are suitably secured to the sides of openings 22. The slots 53 are arcuate in shape as are the keys 52 on the blades 24.

The blades 24 are preferably arcuate shaped, as shown, with a radius of curvature corresponding to that of keys 52 and having their outer ends pointed. Such outer end portion of the blades and all portions of the blades coming into cutting engagement either with the casing or the cement between the casings may be suitably surfaced with hard-facing material adapted for cutting in such situations such as tungsten carbide.

Figure 3:
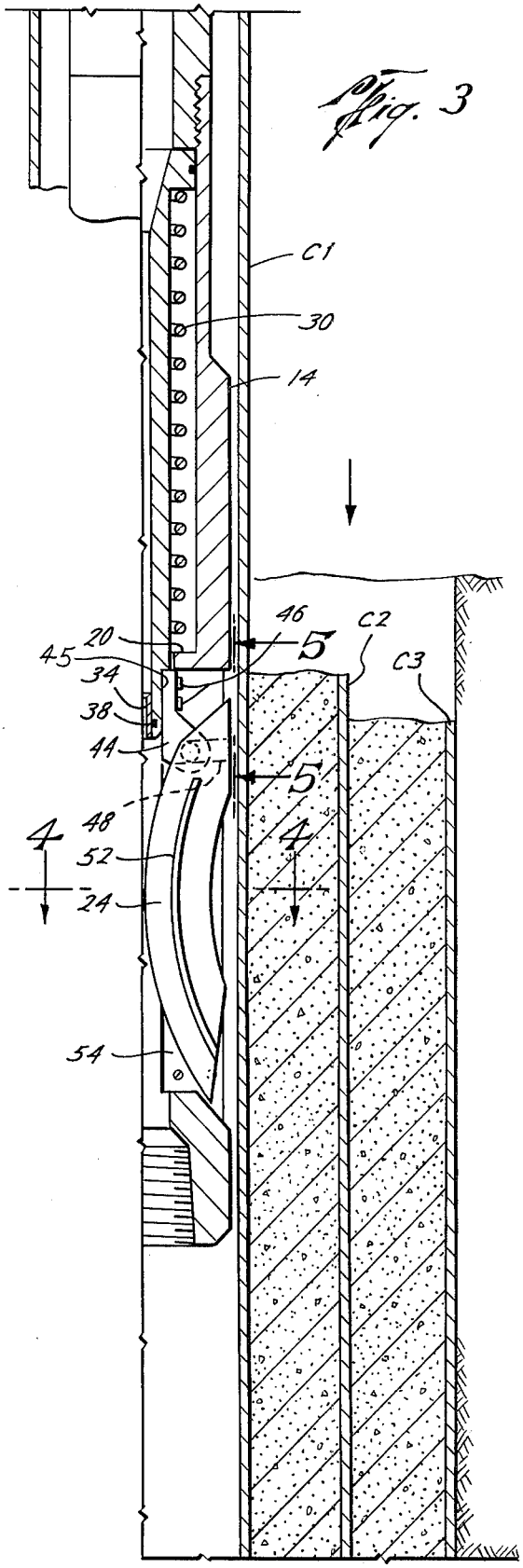

As can be seen in a comparison of FIGS. 1, 2 and 3, the improved casing cutter of the present invention is connected onto a drill string D and run into the well bore with the parts in the positions shown in FIG. 3. When the cutter is at the level at which it is desired that the casings be severed, circulation through the drill string is commenced together with rotation of the drill string. The rotation of the drill string D rotates the casing cutter and the circulation of the fluid downward through the drill string D creates a pressure drop across the actuating means causing the piston 28 to move downwardly and exert a downward force on the pins 47 and on the slots 48 in the cutter blades 24.

As the blades begin to move downwardly, the keys 52 and slots 53 guide them in the aforementioned arcuate path. To follow such a path, the blades must move downwardly with respect to housing 14 and must also pivot outwardly. The pins 47 with slots 48 provide for such pivoting. However, it can be seen that as the lower end of the blade 24 moves outwardly in the arcuate path from the position of FIG. 3 to that of FIG. 2, the upper end of the blade must move radially inwardly somewhat. The extension of slot 48 in the generally radial direction allows such relative movement of the upper end of the blade 24 with respect to the pin 47. Thus with blade 24 in the position of FIG. 3, the pin 47 is located at the radially inner end of slot 48. As the upper end of blade 24 moves toward the center of the arcuate slot 53, the relative positions change so that the pin 47 is adjacent the radially outer end of the slot 48 (see FIG. 2). Then upon further downward movement of the piston 28, the upper end of blade 24 begins to move radially outwardly so that, when the blade is fully extended as shown in FIG. 1, the pin 47 is once again adjacent the inner end of slot 48.

Guide means 52, 53 force the cutter blades outwardly into cutting engagement with the inner casing $C_1$ by translating longitudinal force to radial force. As cutting progresses responsive to rotation, the pressure created by the flow of fluid downwardly through the orifice 34 creates an outwardly directed force on the cutter blades 24 which is sufficient for causing the cutter blades to cut the narrow arcuate swath 58 as clearly shown in FIG. 1. The swath 58 is arcuate in longitudinal cross section and its vertical dimension is not substantially greater than the thickness of the blades 24 measured between surfaces 24*a* and 24*b*. The swath 58 is cut primarily by the leading edge of the blade 24 as it gradually moves downwardly and outwardly in its arcuate path (compare FIGS. 2 and 1).

The elongate ribs 52 provide a substantial bearing surface. Furthermore, ribs 52 fill the slots 53 during running-in and retrieval to prevent the latter from becoming fouled with debris, etc.

It can be seen that, because the guide means 52, 53 are disposed radially outwardly of the outer diameter of sleeve 40, they offer no impedence to the downward movement of the latter which may move into the position of FIG. 1.

Figure 8:
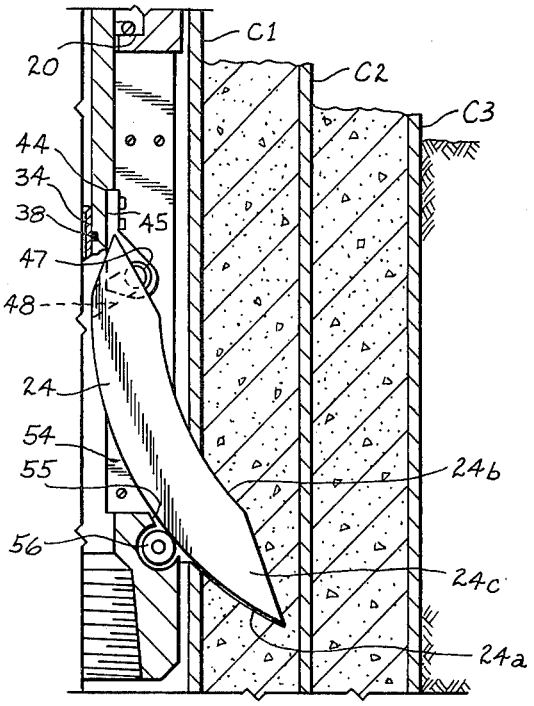
FIG. 8 is a partial sectional view showing a modified form of the casing cutter.

FIG. 8 shows another embodiment of guide means which provide for an arcuate path of the blades without interfering with downward movement of sleeve 40. The lower end of the housing 14 defining the openings 22 tapers upwardly and radially inwardly to form the surfaces 55 against which the arcuate inner surfaces 24*a* of the blades 24 are adapted to slide as the blades are actuated to cutting position. Surfaces 55 and 24*a* cooperate to translate a portion of the downward force on the blades into an outward force. If desired, rollers 56 or other suitable friction reducing means may be provided on surfaces 55.

It can be seen that with either of the two embodiments of guiding means shown, the openings 22 are continuous with the central bore of the housing 14 along a substantial portion of their lengths from their upper extremities to a point near their lower extremities. Accordingly, the area of the tool disposed radially inwardly adjacent the blades 24 in their retracted position (FIG. 3) is free over a substantial portion of the lengths of the blades. Thus the sleeve 40, which is attached to the upper end of the blades, is free to move downwardly a substantial distance into the area adjacent the space which was previously occupied by the blades (FIG. 3). In neither case do the guide means impede this motion. This in turn allows the blades to be extended radially outwardly of the housing 14 over a major portion of their lengths which permits a large diameter swath to be cut without excessive blade length. Thus the tool of the invention may cut a plurality of concentric or eccentric casings, yet it is relatively compact.

Still other embodiments of guide means might be used in the tool of the present invention. For example, while the guide means preferably define a blade path which is arcuate in a longitudinal plane, the path may be other than arcuate as long as it includes both longitudinal and radial components of direction whereby a portion of the downward force of the piston 28 is translated into an outward force on the blades. For example, the path might describe an elipical arc or even a straight line at an acute angle to the tool centerline.

When cutting is completed the circulation of fluid downwardly through the drill string D is stopped and spring 30 urges piston 28 upwardly within cylinder 18. This results in piston 28 and connecting means 42 moving upwardly to retract the blades 24 into their respective openings 22 as in the running-in position of FIG. 3. When the blades are fully retracted the drill string D may be retrieved.

Figure 7:
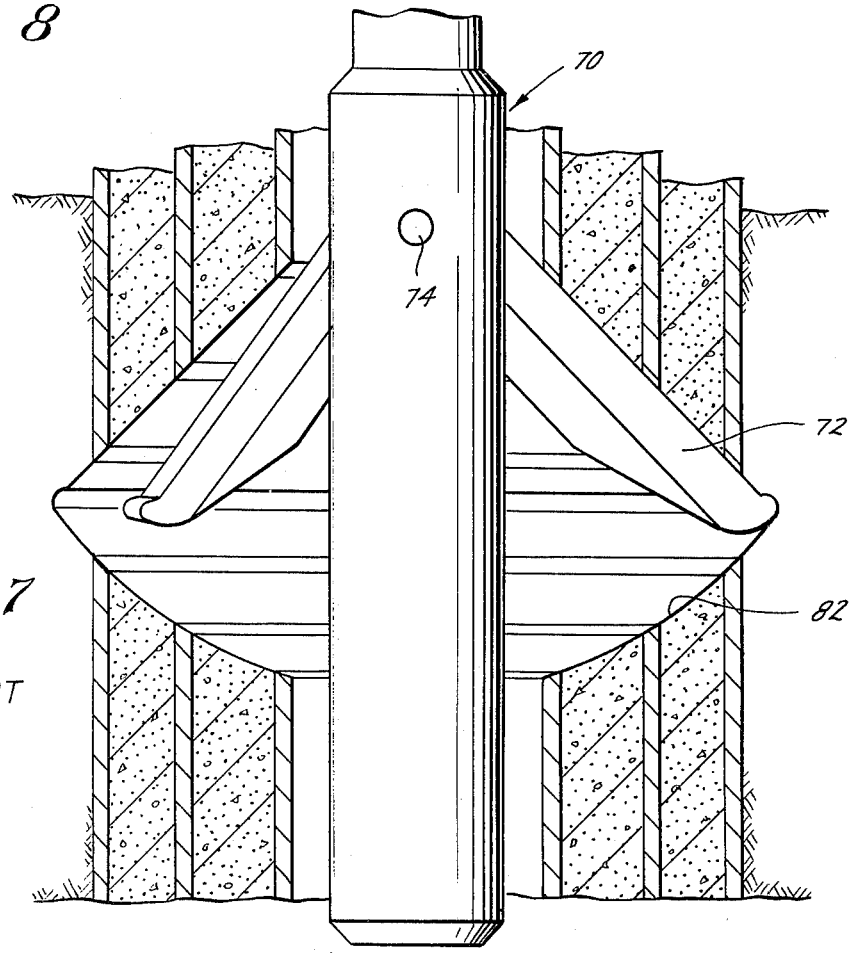
Fig. 7 PRIOR ART
FIG. 7 is a sectional view of a prior art type of casing cutter to illustrate the swath cut by such cutter in severing all of the casings.

The minimum size of the swath 58 cut by the improved casing cutter of the present invention can be best seen when it is compared to the very substantial bell-shaped swath 82 cut by the casing cutter 70 of the prior art as shown in FIG. 7. From this illustration it can be seen that the cutter blades 72 pivot about the pin 74 and cut the bell-shaped area 82 in extending outwardly to cut the outermost of the casings.

Figure 6:
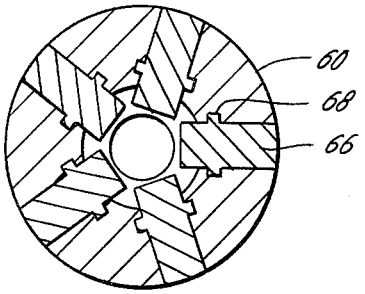
FIG. 6 is a sectional view similar to FIG. 3 showing a modified form cf tool having five cutter blades.

A modified form of the present invention is shown in FIG. 6 wherein five arcuate cutting blades 66 are shown mounted by the pins 68 to the blade housing 60.

I claim:

1. A cutting tool comprising:

a housing member having a radial opening therethrough;

a cutting blade member movably mounted on said housing member for at least partial extension and retraction through said opening, said blade member having a cutting portion;

actuating means within said housing member and longitudinally movable in said housing member;

connection means pivotally connecting said blade member to said actuating means distal said cutting portion of said blade member; and guide means cooperative with said blade member for translating a portion of the longitudinal force exerted on said blade member by said actuating means into a radial force whereby said blade member is moved in a path having both longitudinal and radial components with respect to said housing member upon said longitudinal movement of said actuating means;

wherein said connection means is at least partially circumferentially offset with respect to said guide means.

2. The cutting tool of claim 1 wherein said actuating means includes a piston slidably mounted in said housing.

3. The cutting tool of claim 2 wherein said piston is movable in one longitudinal direction to extend said blade member by application of fluid pressure to the interior of said housing member, said piston having an aperture permitting leakage of fluid in said one longitudinal direction, and said actuating means further comprising return means for moving said piston in the other longitudinal direction to retract said blade upon relief of said fluid pressure.

4. The cutting tool of claim 3 wherein said return means comprises a spring interposed between said piston and said housing member.

5. The cutting tool of claim 1 wherein said blade member has at least one generally radially extending side and wherein said guide means is cooperative with said side of said blade.

6. The cutting tool of claim 5 wherein said blade member has another generally radially extending side opposite said one side, and said tool further comprising another such guide means cooperative with said other side of said blade member.

7. The cutting tool of claim 6 further comprising a plurality of said blade members, said housing having a plurality of such radial openings for respective ones of said blade members.

8. The cutting tool of claim 7 being a casing cutter and being adapted for rotation about its longitudinal axis.

9. The cutting tool of claim 5 wherein said connection means permits relative radial movement between said blade member and said actuating means adjacent the pivot point.

10. The cutting tool of claim 9 wherein said guide means includes interengageable means projecting as to one of said members and receiving as to the other of said members.

11. The cutting tool of claim 10 wherein said projecting means extends along a path parallel to that of said blade.

12. The cutting tool of claim 11 wherein said projecting means comprises an elongate rib on said one member, said receiving means comprising a mating elongate slot on the other of said members.

13. The cutting tool of claim 12 wherein said one member is said blade member and said other member is said housing member.

14. The cutting tool of claim 13 wherein said path of said blade member is arcuate.

15. The cutting tool of claim 14 wherein said blade member is arcuate complimentary to its path.

16. The cutting tool of claim 13 wherein said interengageable means on said housing member is formed on a generally radially extending surface of said housing partially defining said opening.

* * * * *